US010342299B2

(12) United States Patent
Reiter

(10) Patent No.: US 10,342,299 B2
(45) Date of Patent: Jul. 9, 2019

(54) SEW-ON MAGNETIC FASTENERS

(71) Applicant: Romag Fasteners, Inc., Orange, CT (US)

(72) Inventor: Howard J. Reiter, Orange, CT (US)

(73) Assignee: ROMAG FASTENERS, INC., Orange, CT (US)

( * ) Notice: Subject to any disclaimer, the term of this patent is extended or adjusted under 35 U.S.C. 154(b) by 0 days.

(21) Appl. No.: 15/949,505

(22) Filed: Apr. 10, 2018

(65) Prior Publication Data

US 2018/0303207 A1 Oct. 25, 2018

Related U.S. Application Data

(60) Provisional application No. 62/487,054, filed on Apr. 19, 2017.

(51) Int. Cl.
*A44B 17/00* (2006.01)

(52) U.S. Cl.
CPC ..... *A44B 17/0041* (2013.01); *A44B 17/00* (2013.01); *A44B 17/0088* (2013.01); *A44D 2203/00* (2013.01)

(58) Field of Classification Search
CPC . A45C 13/1069; H01F 7/0263; H01F 7/0242; E05C 19/16; E05B 47/0038; Y10T 292/11; Y10T 24/32; A44D 2203/00; A47H 2201/01; A44C 5/2076; A44C 15/005; A44C 17/0216; A44C 5/2071; A41F 1/002
USPC ..... 24/303
See application file for complete search history.

(56) References Cited

U.S. PATENT DOCUMENTS 3,372,443 A * 3/1968 Daddona, Jr. ..... A41F 1/002 24/303
5,251,362 A * 10/1993 Rlceman
5,722,126 A 3/1998 Reiter
5,933,926 A 8/1999 Reiter
6,101,688 A 8/2000 Marchesi
(Continued)

FOREIGN PATENT DOCUMENTS

GB 1519246 7/1978

OTHER PUBLICATIONS

ROMAG Magnetic Snaps, Fasteners, and Closures' (ROMAG) Mar. 18, 2017, entire document, especially pp. 1, 3, 5.
(Continued)

*Primary Examiner* — Jack W Lavinder
(74) *Attorney, Agent, or Firm* — Cooper & Dunham LLP

(57) ABSTRACT

A magnetic snap fastener for releasably coupling a first material to a second material. The fastener includes a first fastening assembly affixable to the first material, the first fastening assembly including a first ferromagnetic eyelet having an integrally formed flange and protrusion magnetically coupled to a first toroidal-shaped magnet, the first fastening assembly disposed in a first water-resistant enclosure, and a second fastening assembly affixable to the second material, the second fastening assembly including a second ferromagnetic eyelet having an integrally formed flange and protrusion magnetically coupled to a second toroidal-shaped magnet having an oppositely poled orientation relative to the first magnet, the second fastening assembly disposed in a second water-resistant enclosure. The first and second fastening assemblies providing magnetic coupling to releasably couple the first and second materials.

19 Claims, 6 Drawing Sheets

(56) References Cited

U.S. PATENT DOCUMENTS

| | | | |
|---|---|---|---|
| 6,215,381 | B1 * | 4/2001 | Aoki |
| 6,226,842 | B1 | 5/2001 | Wong |
| 6,378,174 | B1 | 4/2002 | Wong |
| 6,434,801 | B2 | 8/2002 | Grunberger |
| 7,178,207 | B2 | 2/2007 | Wong |
| 9,572,386 | B1 | 2/2017 | Scheer |
| 2007/0266476 | A1 | 11/2007 | Ulrich |
| 2012/0255145 | A1 | 10/2012 | Reiter |
| 2014/0130231 | A1 | 5/2014 | Horton |

OTHER PUBLICATIONS

International Search Report from PCT/US2018/26859, dated Jul. 2, 2018.
Written Opinion of the ISA issued in PCT/US2018/26859, dated Jul. 2, 2018.
www.romag.com.

* cited by examiner

SEW-ON MAGNETIC FASTENERS

CROSS-REFERENCE TO PRIOR APPLICATIONS

This application claims priority to U.S. Provisional Application Ser. No. 62/487,054, filed on Apr. 19, 2017, the contents of which are herein incorporated by reference in its entirety.

FIELD

Embodiments of the present invention generally relate to magnetic fasteners for garments, clothing, or fashion accessories.

BACKGROUND

Magnetic snap fasteners are commonly used to provide convenient releasable coupling of two or more components and/or materials in items such as garments, clothing, fashion accessories, bags, purses, shoes, and the like. Magnetic snap fasteners typically include two portions, each attached to a component or base material, that are designed to magnetically mate with each other. Accordingly, the magnetic mating of the two portions can facilitate releasable coupling of the two components and/or materials to which the magnetic snap fastener is attached.

In past practice, magnetic fasteners have typically been either mounted on the surface of the materials or hidden inside a seam or in a lining. The magnetic circuits of hidden fasteners have generally either been to channel the magnetic flux around the outside of a solid magnetic disk, or through the center of a toroidally shaped magnetic disk. Fasteners which conduct their magnetic flux through a backplate and a central pin which extends through the central bore of the toroidal shaped magnet have been constructed of an assembly of components wherein the backplate and central are separate elements assembled together.

SUMMARY

Embodiments of the present invention can provide a magnetic snap fastener for releasably coupling a first material to a second material. An example of such a fastener can include a first fastening assembly affixable to the first material, where the first fastening assembly can include a first ferromagnetic eyelet having an integrally formed flange and protrusion magnetically coupled to a first toroidal-shaped magnet, and the first fastening assembly can be disposed in a first water-resistant enclosure. The exemplary fastener can further include a second fastening assembly affixable to the second material, where the second fastening assembly can include a second ferromagnetic eyelet having an integrally formed flange and protrusion magnetically coupled to a second toroidal-shaped magnet having an oppositely poled orientation relative to the first magnet, and the second fastening assembly can be disposed in a second water-resistant enclosure. Further, the first and second fastening assemblies can provide magnetic coupling to releasably couple the first and second materials.

According to certain embodiments, the first and second water-resistant enclosures can each be formed between a folded single sheet of water-resistant material. Alternatively, the first and second water-resistant enclosures can each be formed between joined sheets of water-resistant material, or between cast or molded cups of water-resistant material.

According to certain embodiments, the water-impervious material can include a plastic. According to certain aspects, a perimeter of the first and second water-resistant enclosures can be defined by at least one of ultrasonic welding, heat sealing/welding, and high frequency welding. According to certain aspects, the first water-resistant enclosure can be stitchable onto the first material to affix the first fastening assembly to the first material and the second water-resistant enclosure can be stitchable onto the second material to affix the second fastening assembly to the second material. In some applications the enclosures can be affixed to the materials by gluing, bonding, welding, or other joining techniques.

According to certain exemplary embodiments, the first and second ferromagnetic eyelets can be stamped, formed, or drawn from a ferromagnetic material. Additionally, the toroid shaped magnets can each include a center channel or bore, and the protrusion of the first and second ferromagnetic eyelets can be received in the center channel/bore of the toroidal-shaped magnets.

Another embodiment of the present invention can provide a water-resistant magnetic snap fastener including a water-resistant enclosure formed by at least one sheet of a water-resistant material and having a perimeter, a toroidal-shaped magnet disposed in the water-resistant enclosure, and a magnetic fastening element including a ferromagnetic eyelet having an integrally formed flange and protrusion magnetically coupled to and extending through the toroidal-shaped magnet disposed in the water-resistant enclosure.

According to certain embodiments, the at least one sheet of the water-resistant material can be penetrated by a needle to allow the water-resistant magnetic snap fastener to be affixed to a material via stitching or sewing.

According to certain aspects, the perimeter is defined by at least one of heat sealing/joining/welding, ultrasonic welding, or high frequency welding. According to certain aspects, the water-resistant material can include a plastic.

According to certain exemplary embodiments, the ferromagnetic eyelet is stamped, formed, or drawn from a ferromagnetic material.

Further, the toroidal-shaped magnet can include a center channel, and the protrusion of the ferromagnetic eyelet can be received in the center channel of the toroidal-shaped magnet.

According to certain embodiments, the water-resistant enclosure can be formed between a folded single sheet of water-resistant material. Alternatively, the water-resistant enclosure can be formed by joining sheets of water-resistant material.

BRIEF DESCRIPTION OF THE DRAWINGS

The features and advantages of the present invention can be more readily understood from the following detailed description with reference to the accompanying drawings, wherein.

DETAILED DESCRIPTION

Embodiments of the present invention can provide a novel water-resistant sew-on magnetic fastener for clothing, garments, fashion accessories, or any other items requiring a magnetic closure. The fasteners can be substantially water-resistant to prevent water from contacting the fasteners when the item to which they are attached or affixed are exposed to moisture and/or water (e.g., when being washed, encountering weather such as rain and snow, etc.) and are magnetic so that they are easily manipulated, even by persons with limited dexterity and/or use of their fingers.

Figure 1:
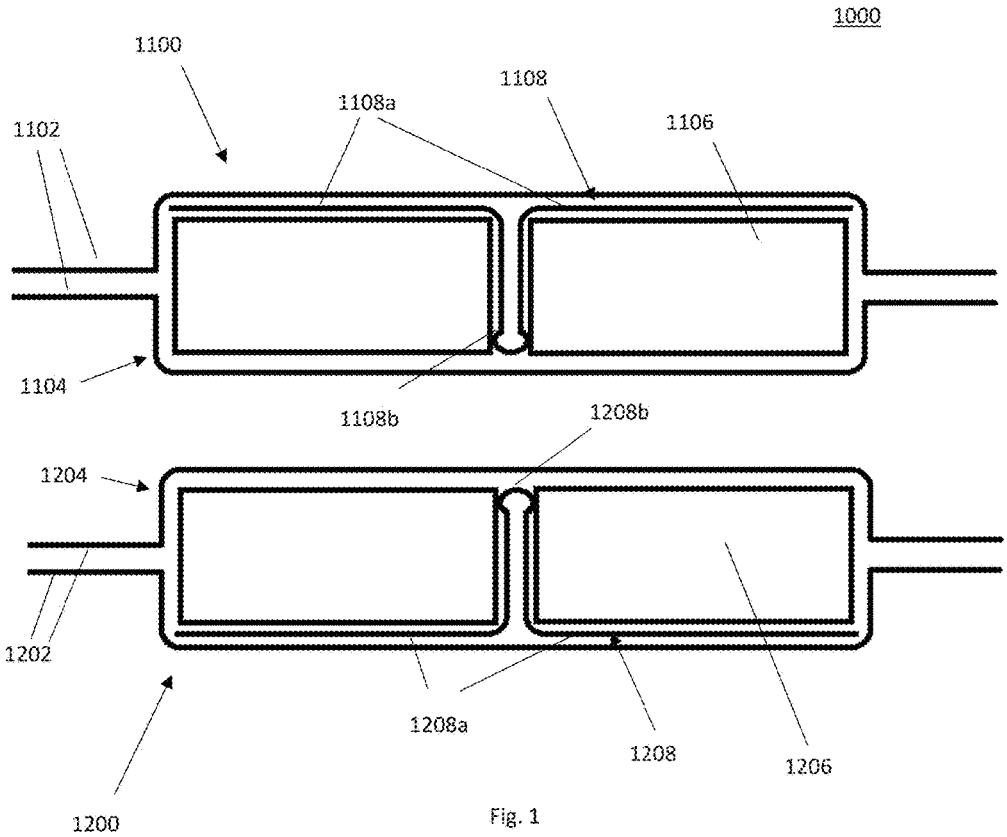
FIG. 1 is a cross-sectional view of an exemplary magnetic snap fastener according to an embodiment of the present invention.

FIG. 1 shows a cross-sectional view of an exemplary magnetic snap fastener 1000 according to an embodiment of the present invention. As shown in FIG. 1, magnetic snap fastener 1000 can include first magnetic fastening assembly 1100, which can be configured to magnetically couple to second magnetic fastening assembly 1200 when first magnetic fastening assembly 1100 and second magnetic fastening assembly 1200 are brought in close proximity to each other. First magnetic fastening assembly 1100 can include magnet 1106 and eyelet 1108 and be disposed in pocket or pouch 1104 formed between covering 1102. Similarly, second magnetic fastening assembly 1200 can include magnet 1206 and eyelet 1208 and be disposed in pocket or pouch 1204 formed between covering 1202. Preferably, the magnets of either magnetic fastening assembly 1100 and 1200 are oriented so that they are oppositely poled with respect to one another. For example, magnet 1106 of magnetic fastening assembly 1100 can be situated with its north-pole against the flange of eyelet 1108 magnet while magnet 1206 of magnetic fastening assembly 1200 can have its south-pole oriented so that it is against the flange of eyelet 1208, or vice versa.

As shown in the Figures, according to certain embodiments, magnets 1106 and 1206 can be toroidal in shape, and eyelets 1108 and 1208, which can be formed from a ferromagnetic material, can be magnetically coupled to magnets 1106 and 1206. As shown in FIG. 1, eyelets 1108 and 1208 can include flange portions 1108*a* and 1208*a*, respectively, and integral rivet-like center protrusions 1108*b* and 1208*b*, respectively. Preferably, eyelets 1108 and 1208 are stamped, formed, or drawn from the ferromagnetic material from which they are made so that rivet-like center protrusions 1108*b* and 1208*b* are integrally formed with flange portions 1108*a* and 1208*a*. This can provide an inexpensive and efficient magnetic closure which could be used for garments, apparel, and many other applications. In forming magnetic fastening assembly 1100 and magnetic fastening assembly 1200, flange portions 1108*a* and 1208*a* can be disposed adjacent to a surface of magnets 1106 and 1206, respectively, and the rivet-like center protrusions 1108*b* and 1208*b* can be received within a center channel of magnets 1106 and 1206, respectively. The shape of eyelets 1108 and 1208 (e.g., rivet-like center protrusions 1108*b* and 1208*b*) channel the magnetic flux of magnets 1106 and 1206 to attenuate the magnetic flux through the center of magnets 1106 and 1206 (e.g., through the toroid's center channel) so that the flux of the magnets is used effectively to attract magnetically to one another. If eyelets 1108 and 1208 were not ferromagnetic, they would not conduct magnetic flux, but would rather be inert to magnetic flux and act simply as a spacer (or an air gap) and would have no effect on the flow of the magnetic flux.

In use, when magnetic fastening assemblies 1100 and 1200 are brought into close relationship, the magnetic attraction of magnets 1106 and 1206 (e.g., one including a magnet oriented with its north pole oppositely to the other magnet) causes magnetic fastening assemblies 1100 and 1200 to magnetically couple with each other. For example, when magnets 1106 and 1206 are brought together, the magnetic flux from the back face of magnet 1106 is channeled through magnet 1106's toroid center by the flange and bump of backplate 1108 and conducted to the magnet 1206's rear surface by eyelet 1208, creating a magnetic circuit. When magnets 1106 and 1206 are attracted in this manner, little flux flows through space at the rear of magnets 1106 and 1206, as the flux is mostly conducted toward the opposing magnet through the ferromagnetic eyelets' flanges 1108*a* and 1208*a*, and integrally formed rivet-like center protrusions 1108*b* and 1208*b*. This results in an efficient magnetic circuit to attract fastening assemblies 1100 and 1200 together and create a magnetic closure. In this regard, fastening assembly 1100, having a particularly poled magnet, is preferably attached to one side of the item or garment, and fastening assembly 1200, having an oppositely oriented magnet, is affixed to the other side of the item or garment.

Figure 4:
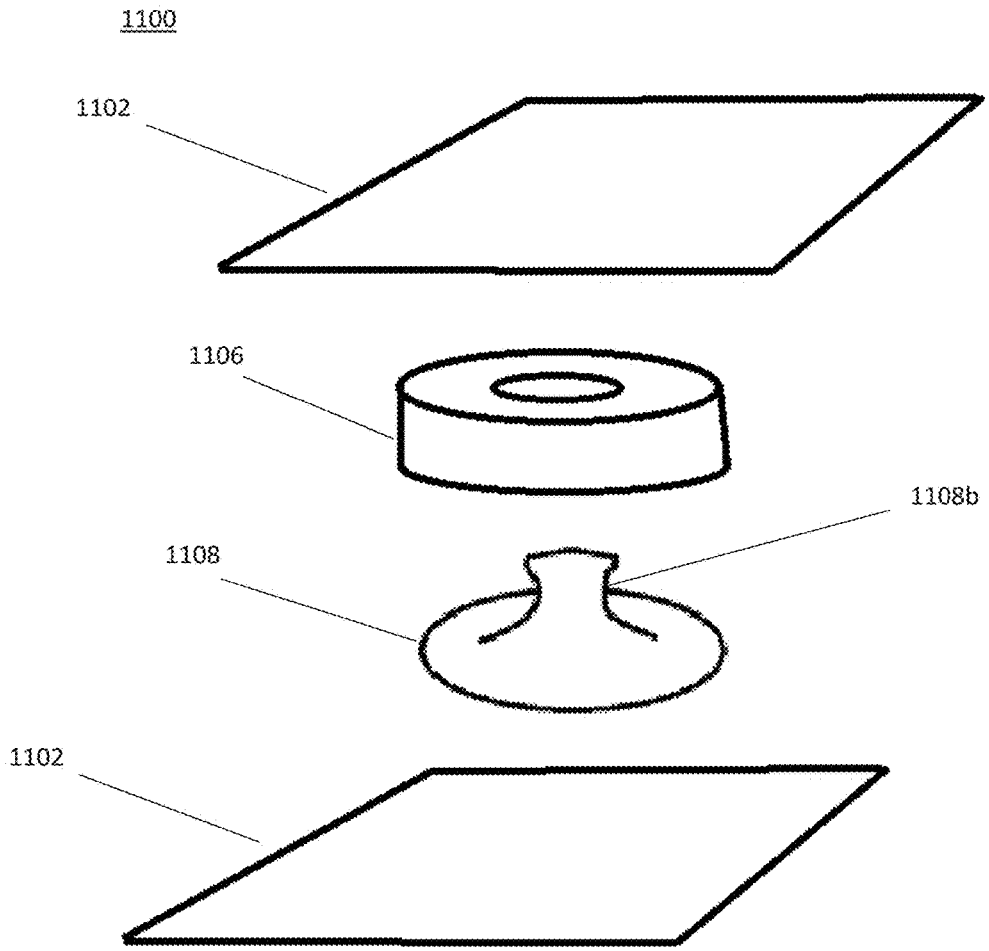
FIG. 4 is an exploded view of an exemplary fastening element of the magnetic snap fastener shown in FIG. 1.

Further, as shown in FIG. 1, magnetic fastening assembly 1100 and magnetic fastening assembly 1200 can be disposed/encased within an enclosure such as pocket or pouch 1104 and 1204 formed by coverings 1102 and 1202, respectively. According to certain embodiments, covering 1102 and 1202 can include a material that is substantially resistant to water/moisture, such as plastics (e.g., thermoplastic polyurethane, etc.), silicone, coated fabrics, etc. so that pocket or pouch 1104 and 1204 are substantially water-resistant enclosures. For example, pocket or pouch 1104 and 1204 can be formed by bonding or sealing (e.g., via ultrasonic welding, high frequency welding, radio frequency welding, heat sealing or welding, adhesives, etc.) coverings 1102 and 1202 along a perimeter of pocket or pouch 1104 and 1204 to encapsulate and form pocket or pouch 1104 and 1204. Although FIGS. 1 and 4 show utilizing two sheets of covering 1102 and/or 1202, alternatively, a single folded sheet of covering 1102 and/or 1202 can be utilized. Other possible constructions may utilize at least one cup that is molded or cast of water-resistant material joined to a sheet or another cup of water-resistant material. According to certain exemplary embodiments, covering 1102 and 1202 can include 0.3 mil or 0.4 mil thick plastics. Preferably, covering 1102 and 1202 includes a thickness of at least 0.3 mil and includes a constant thickness. Alternatively, covering 1102 and 1202 can include any substantially water-resistant material known in the art. Water-resistant pocket or pouch 1104 and 1204 can allow components such as electronics and sensors (e.g., global positioning system (GPS) or other electronic tracking components, radio-frequency identification devices (RFID), security tags, etc.) that may be sensitive to moisture and/or water to be coupled to or embedded in magnetic fastening assemblies 1100 and 1200.

Additionally, pocket or pouch 1104 and 1204 can facilitate securing, affixing, or attaching magnetic fastening assemblies 1100 and 1200 to the item or garment. For example, the material forming coverings 1102 and 1202 can be punctured by a needle and thread to allow magnetic fastening assemblies 1100 and 1200 to be stitched and/or sewn into position onto or into a garment, or other item, so that magnetic fastening assemblies 1100 and 1200 are securely attached to the item. Further, pocket or pouch 1104 and 1204 are preferably substantially water-resistant so that the garment or item to which magnetic fastening assemblies

1100 and 1200 are affixed and/or attached may be washed, cleaned, or exposed to weather such as rain and snow, without exposing magnetic fastening assemblies 1100 and 1200 to the water and/or moisture.

Figure 2A:
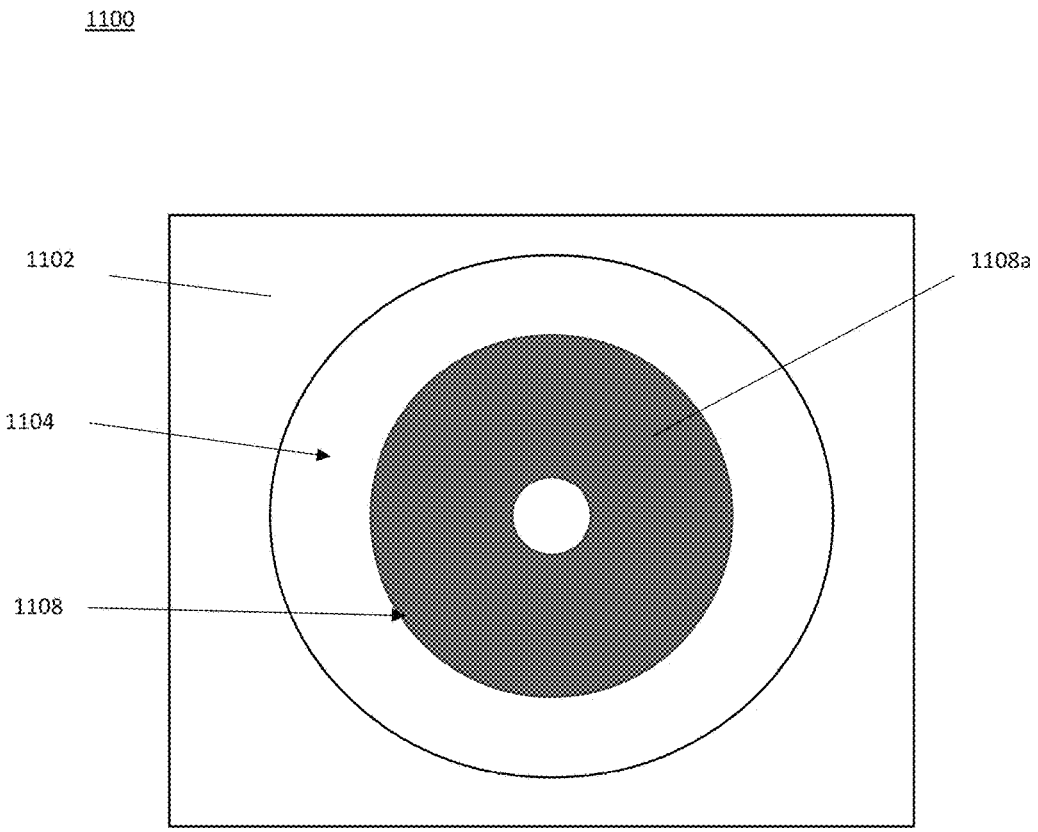
FIG. 2A is a plan view of an exemplary fastening element of the magnetic snap fastener shown in FIG. 1.
Figure 2B:
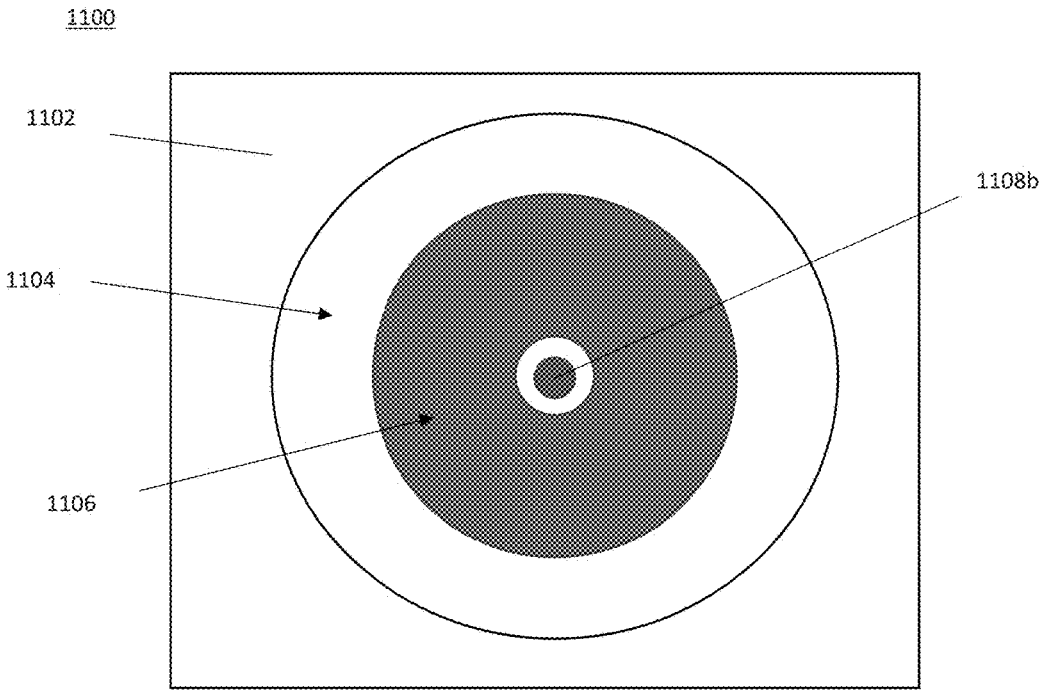
FIG. 2B is a plan view of the exemplary fastening element shown in FIG. 2A.

FIGS. 2A and 2B are plan view illustrations of magnetic fastening assembly 1100 from a top view and a bottom view, respectively. As shown in FIGS. 2A and 2B, magnet 1106 and eyelet 1108 are disposed within pocket or pouch 1104 formed by covering 1102. As shown in FIG. 2A, when viewed from the top, only eyelet 1108 is visible, and magnet 1106 is largely hidden by flange portion 1108*a* of eyelet 1108. Similarly, when viewed from the bottom, as shown in FIG. 2B, eyelet 1108 is largely hidden by magnet 1106, and only rivet-like center protrusion 1108*b* is visible, which is preferably received within a center channel of magnet 1106.

Figure 3A:
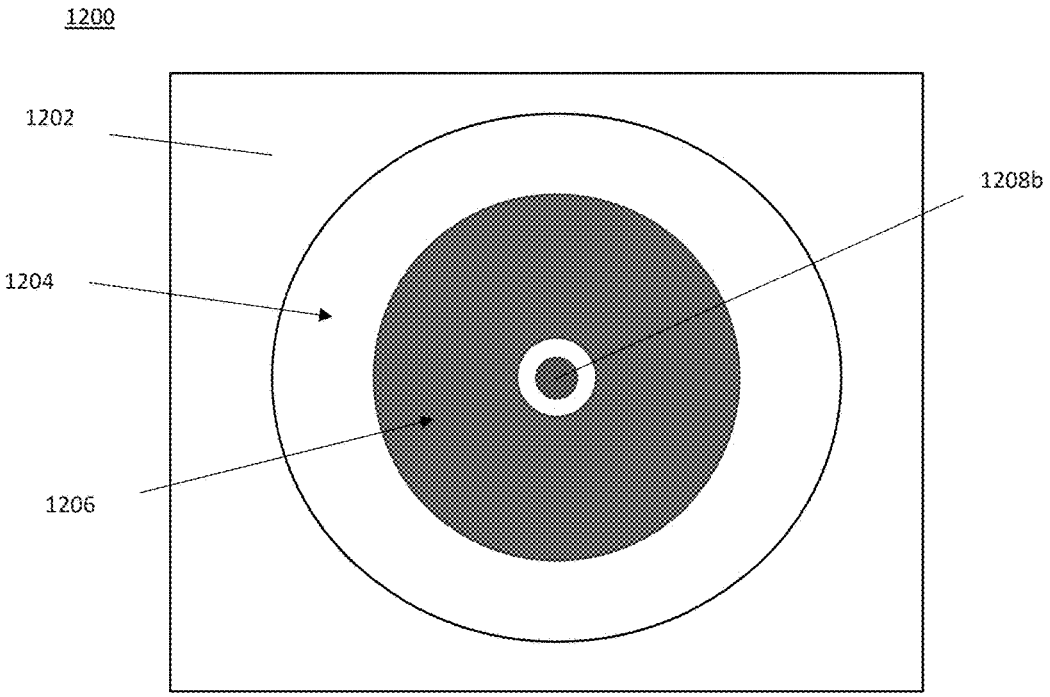
FIG. 3A is a plan view of an exemplary fastening element of the magnetic snap fastener shown in FIG. 1.
Figure 3B:
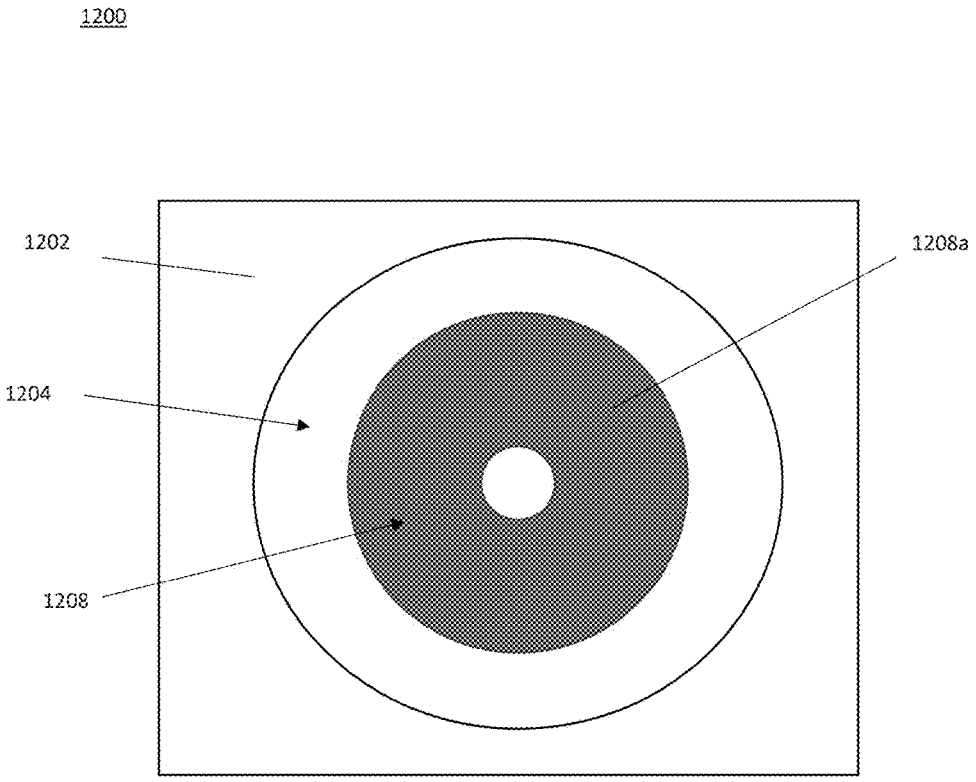
FIG. 3B is a plan view of the exemplary fastening element shown in FIG. 3A.

FIGS. 3A and 3B are plan view illustrations of magnetic fastening assembly 1200 from a top view and a bottom view, respectively. The views of magnetic fastening assembly 1200 shown in FIGS. 3A and 3B are substantially mirror images of the views shown in FIGS. 2A and 2B of magnetic fastening assembly 1100. As shown in FIGS. 3A and 3B, magnet 1206 and eyelet 1208 are disposed within pocket or pouch 1204 formed by covering 1202. As shown in FIG. 3A, when viewed from the top, eyelet 1208 is largely hidden by magnet 1206, and only rivet-like center protrusion 1208*b* is visible, which is preferably received within a center channel of magnet 1206. Similarly, when viewed from the bottom, as shown in FIG. 3B, only eyelet 1208 is visible, and magnet 1206 is largely hidden by flange portion 1208*a* of eyelet 1208.

FIG. 4 shows an exploded perspective view illustration of magnetic fastening assembly 1100. As shown in FIG. 4, magnetic fastening assembly 1100 includes magnet 1106 and eyelet 1108. As described herein, magnet 1106 and eyelet 1108 are preferably disposed within a water-resistant enclosure formed by covering 1102.

The embodiments and examples shown above are illustrative, and many variations can be introduced to them without departing from the spirit of the disclosure. For example, elements and/or features of different illustrative and exemplary embodiments herein may be combined with each other and/or substituted with each other within the scope of the disclosure. For a better understanding of the disclosure, reference should be had to any accompanying drawings and descriptive matter in which there is illustrated exemplary embodiments of the present invention.

What is claimed is:

1. A magnetic snap fastener for releasably coupling a first material to a second material, the fastener comprising:

a first fastening assembly affixable to the first material, the first fastening assembly including a first ferromagnetic eyelet having an integrally formed flange and a hollow protrusion magnetically coupled to a first toroidal-shaped magnet such that the hollow protrusion of the first ferromagnetic eyelet is received in a center channel of the first toroidal-shaped magnet and an outer end of the hollow protrusion is substantially flush with a surface of the first toroidal-shaped magnet, the first fastening assembly disposed in a first water-resistant enclosure; and a second fastening assembly affixable to the second material, the second fastening assembly including a single-piece second ferromagnetic eyelet having an integrally formed flange and a second hollow protrusion stamped or drawn from a single-piece of ferromagnetic material such that the protrusion extends outwardly, the second ferromagnetic eyelet being magnetically coupled to a second toroidal-shaped magnet having an oppositely poled orientation relative to the first magnet such that the second hollow protrusion is received in a center channel of the second toroidal-shaped magnet and an outer end of the second hollow protrusion is substantially flush with a surface of the second toroidal-shaped magnet, the second fastening assembly disposed in a second water-resistant enclosure, the first and second fastening assemblies providing magnetic coupling to releasably couple the first and second materials.

2. The magnetic snap fastener of claim 1, wherein the first and second water-resistant enclosures are each formed between a folded single sheet of water-resistant material.

3. The magnetic snap fastener of claim 2, wherein the water-resistant material comprises a plastic.

4. The magnetic snap fastener of claim 1, wherein the first and second water-resistant enclosures are each formed between joined sheets of water-resistant material.

5. The magnetic snap fastener of claim 1, wherein the water-resistant material comprises a fabric coated with a material rendering it water resistant.

6. The magnetic snap fastener of claim 1, wherein a perimeter of the first and second water-resistant enclosures are defined by at least one of ultrasonic welding, high frequency welding, and heat sealing/welding.

7. The magnetic snap fastener of claim 1, wherein the first water-resistant enclosure is stitchable onto the first material to affix the first fastening assembly to the first material and the second water-resistant enclosure is stitchable onto the second material to affix the second fastening assembly to the second material.

8. A water-resistant magnetic snap fastener comprising:

a water-resistant enclosure formed by at least one sheet of a water-resistant material;

a toroidal-shaped magnet disposed in the water-resistant enclosure;

a magnetic fastening element including a single-piece ferromagnetic eyelet having an integrally formed flange and a hollow protrusion stamped or drawn from a single-piece of ferromagnetic material such that the protrusion extends outwardly, the ferromagnetic eyelet being magnetically coupled to and extending through the toroidal-shaped magnet such that an outer end of the hollow protrusion is substantially flush with a surface of the toroidal-shaped magnet and is disposed in the water-resistant enclosure;

a second water-resistant enclosure formed by at least one second sheet of a water-resistant material;

a second toroidal-shaped magnet disposed in the second water-resistant enclosure; and a second magnetic fastening element including a second single-piece ferromagnetic eyelet having an integrally formed flange and a hollow protrusion stamped or drawn from a single-piece of ferromagnetic material such that the protrusion extends outwardly, the ferromagnetic eyelet being magnetically coupled to and extending through the second toroidal-shaped magnet such that an outer end of the hollow protrusion is substantially flush with a surface of the second toroidal-shaped magnet and is disposed in the second water-resistant enclosure.

9. The water-resistant magnetic snap fastener of claim 8, wherein the at least one sheet of the water-resistant material and the at least one sheet of second water-resistant material can be penetrated by a needle to allow the water-resistant magnetic snap fastener to be affixed to a material via stitching or sewing.

10. The water-resistant magnetic snap fastener of claim 8, wherein a perimeter of the water-resistant enclosure is defined by at least one of ultrasonic welding, heat sealing/welding, and high frequency welding.

11. The water-resistant magnetic snap fastener of claim 8, wherein the water-resistant material comprises a plastic.

12. The water-resistant magnetic snap fastener of claim 8, wherein the water-resistant material comprises a fabric coated with a material rendering it water resistant.

13. The water-resistant magnetic snap fastener of claim 8, wherein the toroidal-shaped magnet includes a center bore, or center channel, and the protrusion of the ferromagnetic eyelet is received in the center channel of the toroidal-shaped magnet.

14. The water-resistant magnetic snap fastener of claim 8, wherein the water-resistant enclosure is formed between a folded single sheet of water-resistant material.

15. The water-resistant magnetic snap fastener of claim 8, wherein the water-resistant enclosure is formed between joined sheets of water-resistant material.

16. The water-resistant magnetic snap fastener of claim 8, wherein the second toroidal-shaped magnet includes a center bore, or center channel, and the hollow protrusion of the second ferromagnetic eyelet is received in the center channel of the second toroidal-shaped magnet.

17. The water-resistant magnetic snap fastener of claim 8, wherein the second water-resistant enclosure is formed between a folded single sheet of water-resistant material.

18. The water-resistant magnetic snap fastener of claim 8, wherein the second water-resistant enclosure is formed between joined sheets of water-resistant material.

19. The water-resistant magnetic snap fastener of claim 8, wherein a perimeter of the second water-resistant enclosure is defined by at least one of ultrasonic welding, heat sealing/welding, and high frequency welding.

* * * * *